US005705063A

United States Patent [19]

Lee

[11] Patent Number: 5,705,063

[45] Date of Patent: Jan. 6, 1998

[54] VENTILATING DISK ASSEMBLY

[76] Inventor: Shou-Hua Lee, 2F, No.33, Lane 176, Sec. 5, Roosevelt Rd., Taipei, Taiwan

[21] Appl. No.: 816,245

[22] Filed: Mar. 13, 1997

[51] Int. Cl.[6] ..... B01F 3/04

[52] U.S. Cl. ..... 210/220; 261/122.2

[58] Field of Search ..... 210/220; 261/122.1, 261/122.2

[56] References Cited

U.S. PATENT DOCUMENTS

| | | |
|---|---|---|
| Re. 33,812 | 2/1992 | Schneider . |
| 3,396,950 | 8/1968 | Wood . |
| 4,007,240 | 2/1977 | Gosden . |
| 4,046,845 | 9/1977 | Veeder . |
| 4,629,126 | 12/1986 | Goudy . |
| 4,764,314 | 8/1988 | Schneider . |
| 4,842,779 | 6/1989 | Jager . |
| 4,848,749 | 7/1989 | Schneider . |
| 5,330,688 | 7/1994 | Downs . |

*Primary Examiner*—Thomas M. Lithgow
*Attorney, Agent, or Firm*—Pro-Techtor International

[57] ABSTRACT

The present invention relates to an improved ventilating disk assembly. When the air pressure applied thereof is changed, different stirring effect can be attained and the debris or soil accumulated onto the ventilating disk can be readily removed. The improved ventilating disk assembly comprises a ventilating disk, a resilient foot disk, a biasing rod and a basement. Characterized in that the resilient foot disk is provided with a plurality of projections which are in align with a plurality of coarse holes distributed on the ventilating disk. When the pressure of the supplied air is lowered than a preset limit, the supplied air is injected from the fine ventilating holes. When the air pressure of the supplied exceeds the preset limit, the projections plugged within the coarse holes will be released such that the excess air can be ventilated through those coarse holes. By this arrangement, the resilient ventilating disk is prevented from being damaged. Furthermore, the vibration of the foot disk can be transmitted to the ventilating disk such that the debris accumulated thereof can be readily removed.

1 Claim, 5 Drawing Sheets

VENTILATING DISK ASSEMBLY

FIELD OF THE INVENTION

The present invention relates to an improved ventilating disk assembly wherein the ventilating disk is provided with a resilient sealing foot disk to seal a plurality of coarse ventilating holes. The sealing force exerted to said coarse ventilating holes can be readily adjusted by a biasing rod and an upper and lower adjusting nuts. Characterized in that the resilient foot disk can be readily separated from the ventilating holes when an excess air pressure is applied. The debris attached to the ventilating disk can be readily removed therefrom.

DESCRIPTION OF PRIOR ART

In the waste water treating system by suspended micro-organisms, in order to facilitate the organic material and/or substance can be readily oxidized by the aerobic micro-organisms, such that sufficient oxygen can be solved in the water. In facilitating the solving of oxygen within the water, the waste water to be treated pressurized air or stirring by mechanic propeller. In the ventilating treating system, the pressurized air is pumped by a blower into the water such that a plurality of tiny air bulbs are coming into the waste water. When the air bulbs float to the surface, the oxygen contained within the air bulbs may solved into the waste water. Accordingly, the solved oxygen contained within the water can be increased such that the aerobic micro-organisms can facilitate the oxidizing process of organic material and/or substance.

Besides, in the ventilating type waste water treating system, the oxygen solving performance within the water is proportional to the duration of the bulbs stayed within the water and the dimensions of the bulbs. The smaller the bulbs, the longer the stationary time of the air bulb within the water, consequently, the high the solving performance of the oxygen in the water. Nevertheless, the smaller bulbs, the floating effect is not strong enough such that the waste water is not well stirred. Accordingly, the solved oxygen may only be concentrated within some special ventilating area and the result is poor.

To the contrary, the larger the air bulbs, the stronger the floating force. The water can be well stirred. However, the air bulbs float to the surface quickly such that the solving performance of the oxygen is poor.

In the conventional blower and the air delivery pipe, a gas solver (normally referred to a ventilating disk) is attached on the free end of the pipe. A porous stone having a plurality of orifices is disposed on the basement of the ventilating disk and when the pressurized air is supplied to the porous stone, the pressurized air may readily be injected from the orifices of the porous stone. Consequently, those tiny air bulbs may float to the surface and the oxygen contained within the air bulb may solve in the water. However, the porous stone may readily be cracked resulted from aging effect. Besides, those orifices may also be plugged by debris contained within the waste water. These problems are apparently to the skilled in the art.

In order to solve this problem, as shown in FIG. 1, a measurement is provided. A rubber disk 11 is attached to the basement 12. Then a plurality of screws 13 are applied to insert firstly into the holes 141 of the circular ring 14 and the holes 111 disposed at the outer peripheral of the rubber disk 11. Finally, those screws 13 are locked into the holes 121 of the outer peripheral of the basement 12. By this arrangement, the pressurized air can be supplied to the basement 12 via the delivery pipe 121. The rubber disk 11 is provided with a plurality of I-shape holes 112 which is closed by the resilience of rubber material in normal state. When the pressurized air is supplied, the I-shape holes 112 on the rubber disk 11 can be opened with the air pressure exerted thereof. Accordingly, the pressurized air is injected into the water. Those resulted air bulbs may have a comparatively small diameter such that the stationary time within the water can be prolonged to enhance an excellent oxygen solving effect.

Even the above described rubber disk 11 may readily achieve its designed goal and is resistant to the cracking resulted from aging effect or even it may bring a more homogenous solved oxygen distribution, it can be still concluded with the following defects resulted form the I-shape hole 15.

1) When a surge air pressure is occurred within the system, those I-shape holes may not complete discharge this air pressure such that the rubber disk 11 may readily damaged by this saturated air pressure.
2) The I-shape holes 15 may readily plugged by the accumulation of debris penetrated therein after a period of usage. Consequently, the air flow will be negatively influenced.
3) The dimension of the I-shape holes 15 is fixed which limits the application of the rubber disk 11.

SUMMARY OF THE INVENTION

It is the objective of this invention to provide an improved ventilating disk assembly wherein the problems encountered by the conventional art can be adequately solved.

In order to achieve the object set forth, a biasing rod is provided between the ventilating disk and the basement and a resilient foot disk is disposed on the biasing rod. The ventilating disk is provided with a plurality of fine holes and coarse holes. The bottom of the foot disk has a tapered surface having a plurality of projections disposed thereof. Each of the projections is aligned with a corresponding ventilating course holes distributed on the ventilating disk such that those ventilating holes can be readily and conveniently plugged by those projections. By this arrangement, a plurality of tiny air bulbs can be formed with the pressured air is injected from those fine holes into the water. When a surge air pressure is occurred and the pressure built-up is larger than the resilient force exerted by the foot disk, those projections will be readily separated from the coarse holes to release the air. By this arrangement, the foot disk will be vibrated by the large bulbs generated by the coarse holes. Consequently, this vibrating movement will be transmitted to the ventilating disk such that the debris accumulated thereof will be removed.

According to one aspect of the present invention, the coarse holes may generate a comparatively large air bulbs which may stir the water violently such that the solving rate of oxygen can be increased.

According to one aspect of the present invention, the biasing rod is provided with an adjusting knob such that the distance between the resilient rubber disk and the ventilating disk can be readily adjusted. By this arrangement, the sealing force applied by the rubber foot disk can be readily controlled.

According to another aspect of the present invention, a limit nut is provided at the lower end of the biasing rod such that the extending height of the ventilating disk can be readily controlled.

BRIEF DESCRIPTION OF DRAWINGS

In order that the present invention may more readily be understood the following description is given, merely by way of example with reference to the accompanying drawings, in which:

FIG. 4A is an enlarged view of the area circled in FIG. 4;

FIG. 5A is an enlarged view of the area circled in FIG. 5;

DETAILED DESCRIPTION OF PREFERRED EMBODIMENT

Figure 1:
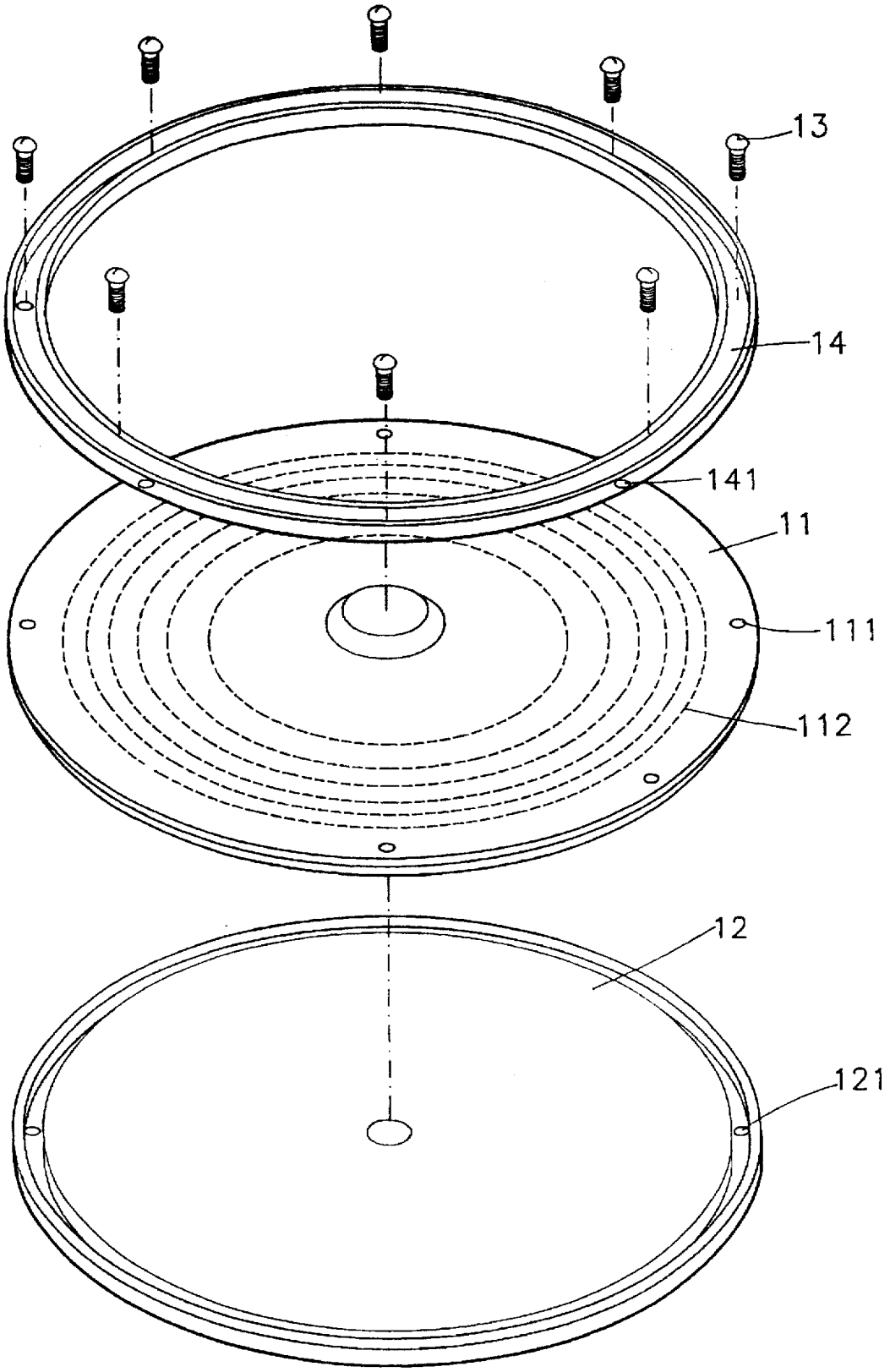
FIG.1 (PRIOR ART)
FIG. 1 is an exploded perspective view of a conventional ventilating disk.
Figure 2:
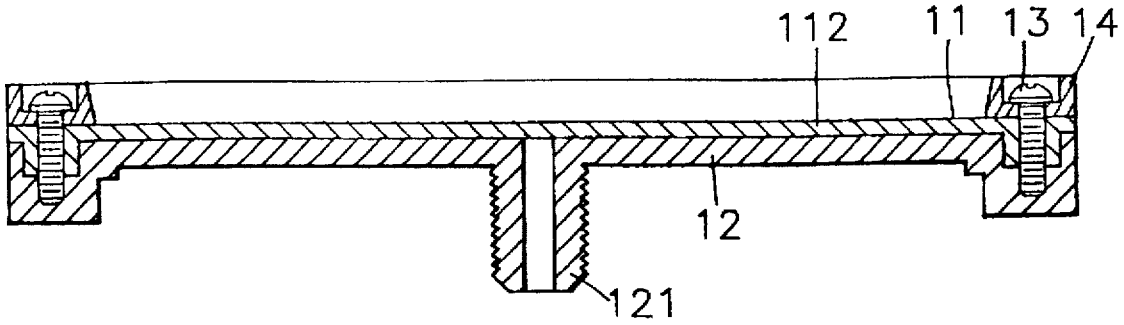
FIG.2 (PRIOR ART)
FIG. 2 is a cross sectional of the ventilating disk shown in FIG. 1.
Figure 3:
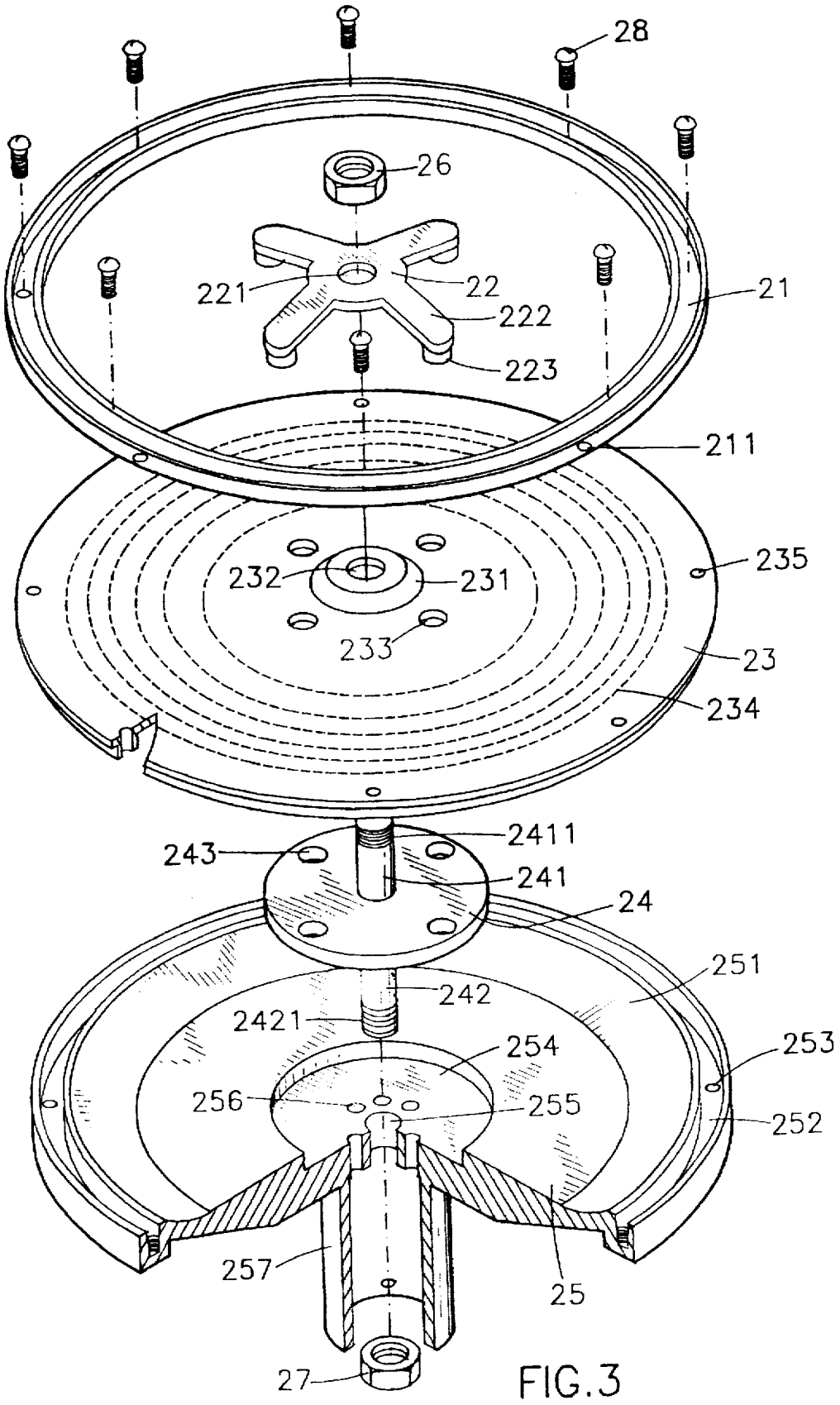
FIG. 3 is an exploded perspective view of the improved ventilating disk assembly made according to the present invention.
Figure 4:
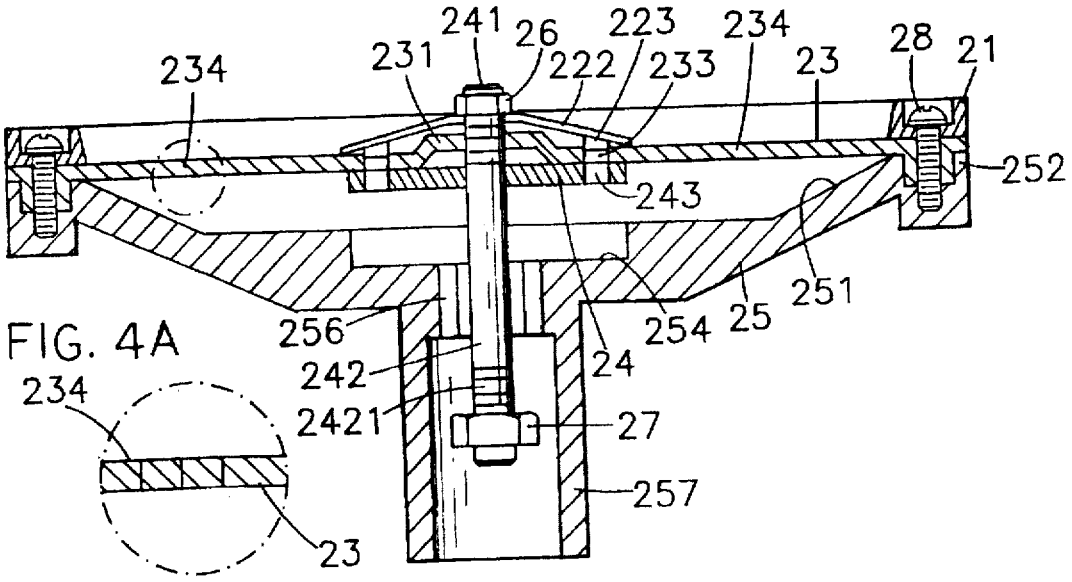
FIG. 4 is a cross sectional view of the ventilating disk assembly shown in FIG. 3.

Referring to FIGS. 3 and 4, the improved ventilating disk assembly made according to the present invention generally comprises a circular ring 21, a resilient foot disk 22, a ventilating disk 23, a biasing rod 24, a basement 25 and an upper and lower nuts 26 and 27.

The circular ring 21 is configured to have an U-shape cross section having a plurality of holes 211 thereof.

The resilient foot disk 22 has a circular configuration having a through hole 221 in the central portion. A plurality of legs 222 extending radially and outwardly from the peripheral. Each of the legs 222 is extended downward and is provided with a projection 223 thereunder.

The ventilating disk 23 is provided with a truncate portion 231 in the central portion. The truncate portion 231 is provided with a through hole 232 in the central portion. A plurality of coarse holes 233 corresponding to those of the projections 223 of the resilient foot disk 22 are provided on the ventilating disk 23 away from the truncate portion 231. The ventilating disk 23 further includes a plurality of I-shape fine holes 234. The peripheral further includes a plurality of holes 235.

The biasing rod 24 has a disk configuration having an upper bolt 241 and a lower bolt 242. Each of the upper and lower bolts 241, 242 is provided with a threaded portion 2411 and 2421 the free end portion. The peripheral of the biasing rod 24 is provided with a plurality of holes 243.

The basement 25 has a circular configuration having an inclined surface 251 directed inwardly from the outer peripheral. The peripheral of the basement 25 is provided with a concentric ring 252. The concentric ring 252 is also provided with a plurality of through hole 255. The concentric ring 252 further includes an annular slot 254 having a through hole 255 thereof. The outer peripheral of the through hole 255 is provided with a plurality of delivery holes 256 having connected with a delivery pipe 257 thereof.

In assembling those described components, the biasing rod 24 is firstly disposed between the ventilating disk 23 and the basement 25 such that the upper bolt 241 can pass through the through holes 232 of the ventilating disk 23 and then inserts into the central through hole 221 of the foot disk 22. Then an upper nut 26 can be screwed onto the threaded portion 2411 of the upper bolt 241 to position the resilient foot disk 22. Meanwhile, a plurality of screws 28 can be applied to insert into the holes 211, 235 and 253 of the circular ring 21, the ventilating disk 23 and the basement 25 such that the ventilating disk 23 can be positioned. On the other hand, the lower bolt 242 of the biasing rod 24 may pass through the through hole 255 of the basement 25. Then a lower nut 27 can be applied to screw onto the threaded portion 2421 of the lower bolt 242.

Figure 5:
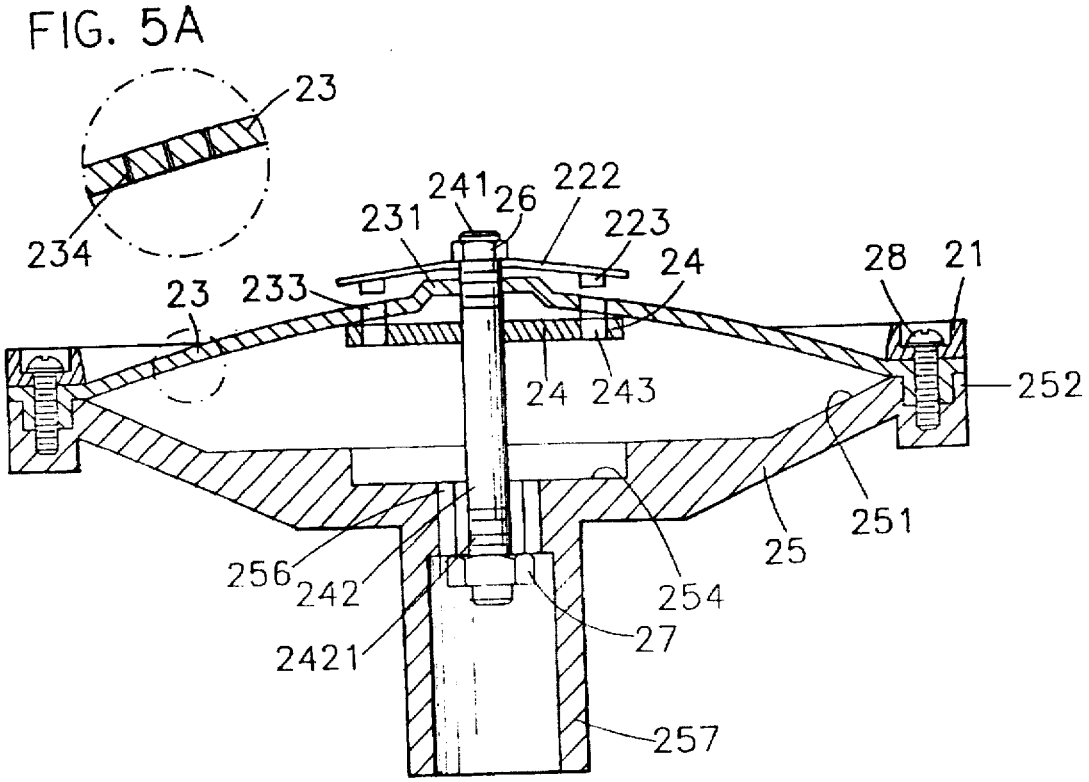
FIG. 5 is a schematic illustration of the ventilating disk assembly made according to the present invention.
Figure 6:
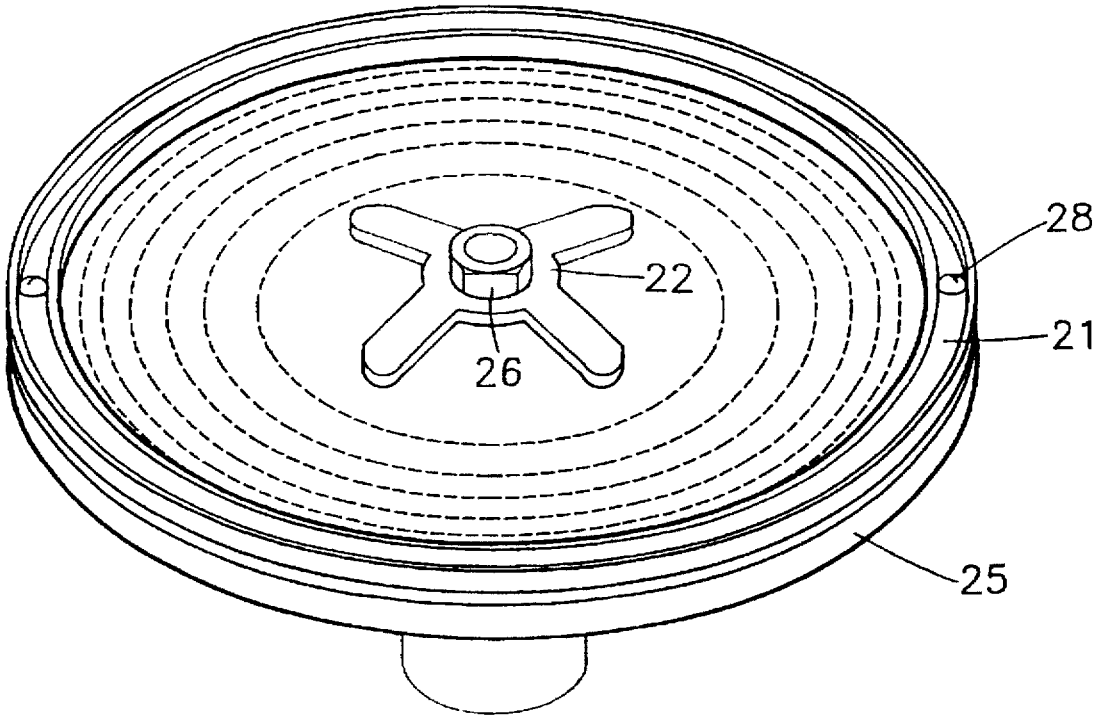
FIG. 6 is a perspective view of the improved ventilating disk assembly made according to the present invention.

As shown in FIG. 5, those described components can be assembled in order to form the ventilating disk assembly and which can be disposed in the bottom of the waste water treating tank. When the blower is started, the pressurized air can be supplied to the basement 25 via the air delivery pipe 257 through the air delivery hole 256. As the pressurized air is continuously pumped in, the air may build-up between the ventilating disk 23 and the basement 25. When the air pressure exceeds a level, the I-shape fine holes 234 on the ventilating disk 23 can be opened as the ventilating disk 23 is made from rubber material. By this arrangement, a plurality of fine air bulbs will be generated as the air injected from the I-shape fine holes 234 into the water.

When the blower supplies a considerably large volume of air flow, the supplied pressurized air may still comes out from those I-shape fine holes 234 and form tiny air bulbs as the air is injected into the water. On the other hand, the over-pressurized air may pass through the through holes 243 and enter into the coarse holes 233 such that the projections 223 of the foot disk 22 can be pushed away from those coarse holes 233 to release the over-pressurized air. While the over-pressurized air is released from the coarse holes 233, the foot disk 22 may also be vibrated as a large quantity of air pass over it. This vibrated movement of the foot disk 22 will be transmitted to the ventilating disk 23 such that the debris attached on the ventilating disk 23 is removed.

On the other hand, the position of the upper nut 26 along the upper bolt 241 can be readily moved to adjust the distance between the resilient foot disk 22 and the ventilating disk 23. Accordingly, the sealing force exerted by the resilient foot disk 22 can be readily adapted to meet the requirements. Similarly, the position of the lower nut 27 along the lower bolt 242 can also be moved to adjust the upper limit of the ventilating disk 23.

I claim:

1. An improved ventilating disk assembly, comprising a circular ring, a resilient foot disk, a ventilating disk, a biasing rod, a basement and an upper and lower nuts, characterized in that said circular ring being configured to have an U-shape cross section having a plurality of holes thereof, said resilient foot disk being configured with a circular configuration having a through hole in the central portion, said further including a plurality of legs extending radially and outwardly from the peripheral, each of said legs being extended downward and provided with a projection thereunder;

said ventilating disk being provided with a truncate portion in the central portion, said truncate portion being provided with a through hole in the central portion, a plurality of coarse holes corresponding to those of said projections of said resilient foot disk being provided on said ventilating disk away from said truncate portion; said ventilating disk further including a plurality of I-shape fine holes, the peripheral said ventilating disk being provided with a plurality of holes;

said biasing rod being configured with a disk configuration having an upper bolt and a lower bolt thereof, each of said upper and lower bolts being provided with a threaded portion the free end portion, the peripheral of said biasing rod being provided with a plurality of holes; and said basement being configured with a circular configuration having an inclined surface directed inwardly from the outer peripheral, the peripheral of said basement being provided with a concentric ring said concentric ring being also provided with a plurality of through hole, said concentric ring further including an annular slot having a through hole in the central portion, the outer peripheral of the through hole being provided with a plurality of air delivery holes having connected with a delivery pipe thereof;

in assembling those described components, said biasing rod being firstly disposed between said ventilating disk and said basement such that said upper bolt can pass through the through holes of said ventilating disk and then inserts into said central through hole of said foot disk, then said upper nut being screwed onto said threaded portion of said upper bolt to position said resilient foot disk, meanwhile, a plurality of screws being applied to insert into said holes said circular ring, said ventilating disk and said basement such that said ventilating disk can be positioned, on the other hand, said lower bolt of said biasing rod being passed through said through hole of said basement, then said lower nut being applied to screw onto said threaded portion of said lower bolt.

* * * * *